US008633640B2

(12) United States Patent
Kyuno et al.

(10) Patent No.: US 8,633,640 B2
(45) Date of Patent: Jan. 21, 2014

(54) SPARK PLUG

(75) Inventors: Jiro Kyuno, Aichi (JP); Akira Suzuki, Aichi (JP); Mamoru Musasa, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 49 days.

(21) Appl. No.: 12/998,935

(22) PCT Filed: Dec. 22, 2009

(86) PCT No.: PCT/JP2009/071305
§ 371 (c)(1),
(2), (4) Date: Jun. 17, 2011

(87) PCT Pub. No.: WO2010/074070
PCT Pub. Date: Jul. 1, 2010

(65) Prior Publication Data

US 2011/0254428 A1 Oct. 20, 2011

(30) Foreign Application Priority Data

Dec. 25, 2008 (JP) ..... 2008-329197

(51) Int. Cl.
*H01T 13/04* (2006.01)

(52) U.S. Cl.
USPC ..... 313/135; 313/118; 313/137; 313/141; 313/142; 313/143; 313/144; 313/145

(58) Field of Classification Search
USPC ..... 313/135, 144, 118, 137, 141, 142, 143, 313/145
See application file for complete search history.

(56) References Cited

U.S. PATENT DOCUMENTS 3,612,931 A * 10/1971 Strumbos ..... 313/11.5
3,743,877 A * 7/1973 Strumbos ..... 313/11.5
4,810,929 A 3/1989 Strumbos ..... 313/11.5

(Continued)

FOREIGN PATENT DOCUMENTS

EP 0480670 4/1992 ..... H01T 13/16
JP 54-092226 2/1952

(Continued)

OTHER PUBLICATIONS

Form PCT/ISA/210—Int'l Search Report (from corresponding Int'l Patent App. No. PCT/JP2009/071305—English version only);1 page.
Notification of Reasons for Rejection from corresponding Japanese Patent App. No. 2010-514173, mailed on Mar. 5, 2013 (with English translation)—11 pages.

*Primary Examiner* — Nimeshkumar Patel
*Assistant Examiner* — Thomas A Hollweg
(74) *Attorney, Agent, or Firm* — Kusner & Jaffe

(57) ABSTRACT

[Objective] To provide a spark plug which is configured such that an insulation member, from which a center electrode projects, is pressed frontward and held in a metallic shell, and is fixed by means of crimping the rear end of the metallic shell, and which can prevent a drop in gas tightness between the metallic shell and the insulation member due to a difference in thermal expansion therebetween.
[Means for Solution] In a spark plug in which a mating shaft portion (10) of an insulation member (1) is loose-fitted into a mating hole portion (30) of a metallic shell (21), a filler (41) for maintaining gas tightness is charged between the outer circumferential surface of the mating shaft portion (10) and the inner circumferential surface of the mating hole portion (30). Despite the thermal expansion difference, the gas tightness is maintained, because the filler (41) for maintaining gas tightness is charged between the inner and outer circumferential surfaces.

10 Claims, 11 Drawing Sheets

(56) References Cited

U.S. PATENT DOCUMENTS

| | | | | |
|---|---|---|---|---|
| 4,870,319 | A * | 9/1989 | Benedikt et al. | 313/137 |
| 5,128,583 | A * | 7/1992 | Ma | 313/137 |
| 6,111,345 | A * | 8/2000 | Shibata et al. | 313/141 |
| 6,548,944 | B1 * | 4/2003 | Morita | 313/118 |
| 2002/0057044 | A1 * | 5/2002 | Klett et al. | 313/140 |
| 2007/0159047 | A1 * | 7/2007 | Ishinada | 313/143 |
| 2008/0061670 | A1 | 3/2008 | Nakayama et al. | 313/143 |

FOREIGN PATENT DOCUMENTS

| | | | |
|---|---|---|---|
| JP | 03-501308 | 3/1991 | H01T 13/16 |
| JP | 6-96836 | 4/1994 | H01T 13/20 |
| JP | 2005129398 | 5/2005 | H01T 13/36 |
| JP | 2008-91322 | 4/2008 | H01T 13/06 |

* cited by examiner

RELATION BETWEEN HEATING TEMPERATURE FOR METALLIC SHELL AND FRACTURE TORQUE IN SCREWING

SPARK PLUG

FIELD OF THE INVENTION

The present invention relates to a spark plug (ignition plug) for an internal combustion engine.

BACKGROUND OF THE INVENTION

A known spark plug for providing ignition in an internal combustion engine, such as an automobile engine, has, for example, a structure shown in FIG. 10 (refer to, for example, Japanese Patent Application Laid-Open (kokai) No. 2005-129398). This spark plug 201 includes an insulation member (ceramic insulator) 1 made of ceramic, assuming the form of a hollow, tubular shaft, and having a center electrode 5 projecting from the front end (lower end in FIG. 10) thereof, and a tubular metallic shell 21, which fixedly holds the insulation member 1 in a surrounding manner. The metallic shell 21 is formed such that the inner circumferential surface is greater in diameter (inside diameter) at a rear portion than at a front portion. The metallic shell 21 has an annular support ledge 24 on the inner circumferential surface of its portion located toward its front end. The support ledge 24 assumes the form of a surface facing rearward and supports an annular butt portion 4, which assumes the form of a surface facing frontward and is provided on the outer circumferential surface of the insulation member 1. In the present patent application, the "front end" refers to the lower end, in FIG. 10, of the spark plug or its component members and regions (or portions), such as the metallic shell 21 and the insulation member 1, and the "rear end" refers to an opposite end (upper end) of the front end.

Meanwhile, the insulation member 1 has the annular butt portion 4, which assumes the form of a surface facing frontward. Butt portion 4 is located at the rear end of a front end shaft portion 7, which is located toward the front end of the insulation member 1 and is tapered frontward. The insulation member 1 is disposed internally of the metallic shell 21 such that the butt portion 4 butts against the support ledge 24 mentioned above. An annular (tubular) insulation space K is formed between the front end shaft portion 7 of the insulation member 1 and the inner circumferential surface of the metallic shell 21. The insulation member 1 has a mating shaft portion 10 located rearward of the front end shaft portion 7 and greater in diameter than the front end shaft portion 7. The mating shaft portion is disposed in a mating hole portion 30 of the metallic shell 21 in a loose fit condition.

In the spark plug (hereinafter, may be referred to merely as plug) 201, the insulation member 1 in which the center electrode 5, etc., are fixed, is inserted into the metallic shell 21 from the rear end of the metallic shell 21 and disposed such that the butt portion 4 butts against the support ledge 24 of the inner circumferential surface of the metallic shell 21 via a ring-like flat packing (metal packing) 42. Then, a crimp portion 39 at the rear end of the metallic shell 21 is bent toward an axis G (radially inward) in such a manner as to cover a facing-rearward surface 14 of a flange-like large-diameter shaft portion 12 located in an axially intermediate region of the insulation member 1, and is strongly pressed frontward, thereby fixing the insulation member 1 in the metallic shell 21. That is, the support ledge 24 of the metallic shell 21 and the butt portion 4 of the insulation member 1 are pressed against each other with the flat packing 42 intervening therebetween, thereby maintaining gas tightness therebetween and fixing the insulation member 1 in a condition in which the insulation member 1 is pressed against a front end portion of the metallic shell 21.

The thus-configured plug 201 is mounted, for use, into a plug hole (threaded hole) of an unillustrated engine head via a mounting screw 25 provided on the outer circumference thereof. At this time, since gas tightness is maintained between the support ledge 24, the flat packing 42, and the butt portion 4, outward leakage of fuel gas (hereinafter, referred to merely as gas) from a cylinder is prevented. Also, heat of the center electrode 5 and the insulation member 1, which assume high temperature as a result of ignition of gas, is propagated (transmitted) to the engine head via the flat packing 42 and the metallic shell 21, thereby preventing an increase in temperature of the front end of the insulation member 1, etc.

During operation of an engine, a front end region of the spark plug 201 assumes high temperature and is exposed to gas blast at all times. Meanwhile, the metallic shell 21 is usually made of an iron-based metal, whereas the insulation member 1 is made of ceramic. Accordingly, when the front end region of the spark plug 201 assumes high temperature, the amount of thermal expansion of the metallic shell 21 becomes far greater than that of the insulation member 1, since the thermal expansion coefficient of the metallic shell 21 is far greater than that of the insulation member 1. Even though such a thermal expansion difference exists between the two members, the thermal expansion difference does not immediately affect the spark plug 201, since the spark plug 201 is assembled in a condition in which the crimp portion 39 at the rear end of the metallic shell 21 is compressively deformed frontward to thereby strongly press the insulation member 1 frontward.

However, since the expansion of the metallic shell 21 along the direction of the axis G is far greater than that of the insulation member 1, the force with which the butt portion 4 of the insulation member 1 is pressed against the support ledge 24 of the metallic shell 21 unavoidably decreases with age. Continuation of such a condition leads to impairment in gas tightness. Eventually, as shown in FIG. 11, a clearance (small clearance) is formed between the support ledge 24, the flat packing 42, and the butt portion 4, resulting in outward discharge of gas through the clearance. Such a problem is likely to worsen as the length of the metallic shell 21 along the axis G and the length of the mounting screw 25 increase.

Also, impairment in gas tightness and the formation of the clearance results in impairment in heat transference for transferring heat of a front end portion of the insulation member 1 to the engine head. As mentioned above, heat of the front end portion of the insulation member 1 is transferred to the engine head via a gas tightness-maintaining portion consisting of the butt portion 4, the flat packing 42, and the metallic shell 21. However, the formation of a clearance in the gas tightness-maintaining portion causes impairment in heat transference. As a result, a front end region of the insulation member 1 and the center electrode 5 assume excessively high temperature, potentially resulting in occurrence of preignition or thermal erosion of the electrode.

The present invention has been conceived in view of the above problem in a spark plug having the above-mentioned structure or configuration, and an object of the present invention is to prevent impairment in gas tightness between a metallic shell and an insulation member in a plug configured such that the insulation member is pressed frontward in the metallic shell to thereby be fixedly held in place.

SUMMARY OF THE INVENTION

Aspect 1. In accordance with the present invention, there is provided a spark plug comprising a shaft-like insulation member made of ceramic and having a center electrode projecting from a front end thereof, and a metallic shell fixing the insulation member in a surrounding manner and having a ground electrode provided at a front end thereof. The insulation member has a front end shaft portion located toward a front end thereof and formed in such a manner as to form an annular insulation space between the front end shaft portion and an inner circumferential surface of the metallic shell, and a mating shaft portion located rearward of the front end shaft portion, having a diameter greater than that of the front end shaft portion, and disposed in a mating hole portion of the metallic shell. The insulation member is inserted into the metallic shell from a rear end of the metallic shell. A frontward movement of the insulation member in the course of insertion is checked at a predetermined position by stopper means. The insulation member is fixed in the metallic shell in a pressed-frontward condition by means of a crimp portion provided at the rear end of the metallic shell being bent toward an axis and pressed frontward. The spark plug is characterized in that a filler for maintaining gas tightness is provided in a filling manner between an outer circumferential surface of the mating shaft portion and an inner circumferential surface of the mating hole portion.

Aspect 2. In accordance with another aspect of the present invention, there is provided a spark plug comprising a shaft-like insulation member made of ceramic and having a center electrode projecting from a front end thereof, and a metallic shell fixing the insulation member in a surrounding manner and having a ground electrode provided at a front end thereof. The insulation member has a front end shaft portion located toward a front end thereof and formed in such a manner as to form an annular insulation space between the front end shaft portion and an inner circumferential surface of the metallic shell, and a mating shaft portion located rearward of the front end shaft portion, having a diameter greater than that of the front end shaft portion, and disposed in a mating hole portion of the metallic shell. The insulation member is inserted into the metallic shell from a rear end of the metallic shell. Frontward movement of the insulation member in the course of insertion is checked at a predetermined position by stopper means. The insulation member is fixed in the metallic shell in a pressed-frontward condition by means of a crimp portion provided at the rear end of the metallic shell being bent toward an axis and pressed frontward. The spark plug is characterized in that the stopper means comprises an annular butt portion of the insulation member located rearward of the mating shaft portion, having a diameter greater than that of the mating shaft portion, and assuming the form of a surface facing frontward, and an annular support ledge of the metallic shell located rearward of the mating hole portion, having a diameter greater than that of the mating hole portion, and assuming the form of a surface facing rearward and the butt portion butts directly or indirectly against the support ledge to thereby check frontward movement of the insulation member. The spark plug is characterized also in that a filler for maintaining gas tightness is provided in a filling manner between an outer circumferential surface of the mating shaft portion and an inner circumferential surface of the mating hole portion.

Aspect 3. In accordance with another aspect of the present invention, there is provided a spark plug as described above, wherein the butt portion butts against the support ledge via an annular packing for maintaining gas tightness.

Aspect 4. In accordance with another aspect of the present invention, there is provided a spark plug as described above, wherein the filler is a heat-resistant adhesive.

Aspect 5. In accordance with another aspect of the present invention, there is provided a spark plug as described above, wherein the filler is a heat-resistant adhesive which cures at 350° C. or lower.

Aspect 6. In accordance with another aspect of the present invention, there is provided a spark plug as described above, wherein the heat-resistant adhesive contains a metal powder.

Aspect 7. In accordance with yet another aspect of the present invention, there is provided a spark plug as described above, wherein the filler is provided in a filling manner in a filling region extending 5 mm or more along a direction of the axis of the spark plug.

In accordance with another aspect of the present invention, there is provided a spark plug as described above, wherein the filler is provided in a filling manner in a filling region extending 5 mm or more along a direction of the axis of the spark plug as measured rearward from a mating front end of the mating shaft portion of the insulation member.

Aspect 9. In accordance with another aspect of the present invention, there is provided a spark plug as described above, wherein the filler is a compressed metal powder, and coming-off prevention means for preventing the metal powder from coming off toward a front end of the spark plug is provided on an inner circumferential surface of the metallic shell or an outer circumferential surface of the insulation member.

Aspect 10. In accordance with still another aspect of the present invention, there is provided a spark plug as described above, wherein the mating hole portion has an inner circumferential surface formed such that a diameter of the inner circumferential surface is not reduced toward a front end of the metallic shell.

Aspect 11. In accordance with another aspect of the present invention, there is provided a spark plug as described above, wherein the metallic shell has a mounting screw formed on an outer circumferential surface thereof for allowing the spark plug to be threadingly mounted into a plug hole of an engine head, and the mounting screw has a thread diameter of M12 or less.

Aspect 12. According to Aspects 1 or 2 of the present invention, the filler is provided in a filling manner between the inner circumferential surface of the mating hole portion of the metallic shell and the outer circumferential surface of the mating shaft portion of the insulation member. Therefore, even though the insulation member moves in the direction of the axis in relation to the metallic shell due to the metallic shell and the insulation member assuming high temperature at their front end portions and differing in thermal expansion coefficient, gas tightness is maintained between the two surfaces along the direction of the axis. That is, even though the metallic shell expands in the direction of the axis to a greater extent than does the insulation member, the inner and outer circumferential surfaces undergo merely a relative slide in the direction of the axis via the filler and are held in close contact with each other via the filler. Therefore, gas tightness between the two surfaces is not impaired.

Also, for a similar reason, heat of the center electrode and that of the insulation member can be transferred to the engine head via the filler and the metallic shell without impairment in heat transference. Therefore, the occurrence of preignition and thermal erosion of the electrode can also be effectively prevented. Needless to say, the difference in expansion between the metallic shell and the insulation member caused by difference in thermal expansion coefficient therebetween arises not only in the direction of the length (axis) of the plug, but also in the radial direction of the plug. However, since dimensions of these components along the radial direction are greatly smaller as compared with those along the direction of the axis, the influence of the difference in thermal expansion along the radial direction can be ignored. In view of applications and environment of use, preferably, the filler for maintaining gas tightness for use in the present invention has excellent heat resistance and heat transference. Typical examples of such filler are epoxy resin and a brazing filler metal. Additionally, an inorganic adhesive is available for use as the filler.

Aspect 13. According to Aspect 3 of the present invention, the butt portion butts against the support ledge via the annular packing for maintaining gas tightness. Thus, higher gas tightness is maintained. That is, in the present invention, gas tightness can be maintained by means of only the filler. Also, by means of a packing for maintaining gas tightness being separately provided in the stopper means in an intervening manner, the performance of maintaining gas tightness can be enhanced. When this is implemented in the form of the configuration of the invention as described above, the following effect is yielded. In the invention described above, the butt portion and the support ledge between which the packing for maintaining gas tightness intervenes are located rearward of the mating shaft portion and the mating hole portion. This location is far away from the front ends of the insulation member and the metallic shell. Thus, the butt portion and the support ledge between which the packing for maintaining gas tightness intervenes are maintained at relatively low temperature as compared with the case where the butt portion and the support ledge are located at a front end portion of the plug. Therefore, the region where the packing is present is quite unlikely to suffer the occurrence of a clearance which is caused by the difference in thermal expansion and impairs gas tightness. Thus, even if the filler should fail to maintain gas tightness, gas tightness would be maintained in the region where the packing is present. In this manner, the very high performance of maintaining gas tightness is ensured.

Aspect 14. According to the invention described in Aspect 4, the filler is a heat-resistant adhesive. Thus, the filler can be easily provided in a filling manner, for example, as follows: in the course of assembly of the plug, before the insulation member is inserted into the metallic shell, the heat-resistant adhesive is applied to at least one of the outer circumferential surface of the mating shaft portion of the insulation member and the inner circumferential surface of the mating hole portion of the metallic shell. Therefore, the workability of assembly is improved. An inorganic adhesive is available for use as the heat-resistant adhesive.

When the filler is a heat-resistant adhesive which cures at 350° C. or lower as in the case of the invention described in Aspect 5, the following effect is yielded. In the case where, in place of such a heat-resistant adhesive, a silver brazing filler metal, for example, is used as the filler, the silver brazing filler metal is applied as follows: heat is applied for heating to, usually, at least 600° C. or so, the temperature depending on the composition of the brazing filler metal, and then the temperature is maintained for a certain time for reflow (fusion), followed by gradual cooling in the atmosphere for curing (setting). Meanwhile, the metallic shell is formed from a low-carbon steel having a carbon content of 0.35% (carbon steel for cold heading having a carbon content of 0.06% to 0.35%) by the following steps: cold forging, thread rolling, partial machining as needed, surface treatment, etc. The thus-formed metallic shell is put to use. Thus, except for the case where the metallic shell is formed from a heat-resistant steel or a heat-resistant alloy, subjection to such high-temperature heat treatment usually causes a deterioration of mechanical strength of the metallic shell. By contrast, in the case of use of a heat-resistant adhesive which cures at 350° C. or lower (epoxy-resin-based adhesive or phenol-resin-based adhesive), such high-temperature heat treatment is not required, so that a deterioration of mechanical strength can be prevented. This is described in detail below.

A brazing process which uses a brazing filler metal is performed in a condition in which, with the insulation member inserted into the metallic shell, the brazing filler metal (silver brazing filler metal) is disposed, at an appropriate position, between the inner circumferential surface of the mating hole portion of the metallic shell and the outer circumferential surface of the mating shaft portion of the insulation member. When the metallic shell undergoes the brazing process, the metallic shell must be heated to at least 600° C.; as a result, a mechanical property (strength) deteriorates. Meanwhile, the spark plug is threadingly mounted into a plug hole (threaded hole) of an engine head via the mounting screw formed on the outer circumferential surface of the metallic shell. Accordingly, when the spark plug whose metallic shell is manufactured through subjection to such heat treatment is screwed into the plug hole, because of the deterioration of strength, the metallic shell may be broken or fractured or may suffer a like problem in the vicinity of the rear end (base region) of the mounting screw.

The inventors of the present invention conducted a "real screwing breakdown test" to study the relation between metallic-shell heating temperature and breaking torque at the time of screwing, and found the following: the metallic shell which is manufactured from an ordinary material as mentioned above by an ordinary manufacturing method as mentioned above suffers no problem when the temperature resulting from application of heat to the metallic shell is 350° C. or lower; however, a deterioration of strength of the metallic shell begins from 400° C., and the strength deteriorates greatly at and above 450° C. In the case of use of a heat-resistant adhesive which cures at 350° C. or lower, such high-temperature heat treatment is not required, so that a deterioration of strength is avoided. In association with a current strong demand for a reduction of the diameter of the metallic shell (reduction of the thread diameter to, for example, M12 or less) of the spark plug, difficulty is encountered in securing wall thickness. Under the circumstance, the above-mentioned effect that a deterioration of strength can be prevented is remarkable. Such a heat-resistant adhesive may be of a resin having a heat-resistant temperature of 150° C. or higher. Examples of such adhesive include thermosetting-resin-based adhesives, such as epoxy-resin-based adhesive and phenol-resin-based adhesive. However, the heat-resistant adhesive is not limited thereto. A heat-resistant thermoplastic resin, such as a thermoplastic resin having a softening point of 150° C. or higher (e.g., nylon and fluororesin), may be used. That is, what is required of the filler is the capability of enduring the temperature of heat to which the filler is exposed in the environment in which the spark plug is used.

According to the invention described in Aspect 6, the heat-resistant adhesive which serves as the filler contains a metal powder; thus, thermal conductivity can be enhanced. Examples of a powder of metal (or alloy) used as the metal powder are a powder of iron, a powder of aluminum or aluminum alloy, and a powder of copper or copper alloy. The metal powder is incorporated in the heat-resistant adhesive through mixing and stirring. The content of the metal powder may be determined as appropriate. Preferably, for enhancement of thermal conductivity, the content of the metal powder is increased. In the case of use of a powder of iron, test results indicate that the powder is contained in an amount of preferably 20% by mass or greater per 100% by mass of the heat-resistant adhesive. The particle size of the metal powder may be determined as appropriate, so long as it is not detrimental to provision of the metal powder in a filling manner. Preferably, the particle size of the metal powder is 1 μm to 10 μm inclusive. The heat-resistant adhesive which contains a metal powder for use as the filler encompasses an electrically conductive adhesive. Such an adhesive may be provided in a filling manner similar to provision in a filling manner of the above-mentioned heat-resistant adhesive.

In the spark plug according to any one of Aspects 4 to 6, a sufficient size of a region where the filler is provided in a filling manner (filling region) is, as described in Aspect 7, 5 mm or more along the direction of the axis of the spark plug, irrespective of the type of the filler. This is experimentally confirmed. In this case, preferably, as described in Aspect 8, the filler is provided in a filling manner in a filling region extending 5 mm or more along the direction of the axis of the spark plug as measured rearward from the mating front end of the mating shaft portion of the insulation member. In this manner, by means of the filler being provided in a filling manner rearward starting from the mating front end of the mating shaft portion of the insulation member, there can be prevented the occurrence of high-temperature gas stagnating or remaining in a fine clearance which would otherwise be formed in a loose-fit region.

According to the invention described in Aspect 9, the filler is a compressed metal powder, and the coming-off prevention means for preventing the metal powder from coming off toward the front end of the spark plug is provided on the inner circumferential surface of the metallic shell or the outer circumferential surface of the insulation member; thus, transference of heat of the insulation member to the metallic shell can be further enhanced. No particular limitation is imposed on the coming-off prevention means, so long as it can prevent coming-off of the metal powder toward the front end of the spark plug. Therefore, the coming-off prevention means may be implemented as follows: the front end of a metal powder charged from the front end of the plug is irradiated with a laser beam along the circumferential direction (along the inner circumferential surface of the metallic shell or the outer circumferential surface of the insulation member) so as to partially fuse or weld together the front end of the charged metal powder and the inner circumferential surface of the metallic shell, thereby providing a seal between the inner and outer circumferential surfaces. The particle size of the metal powder and the density or the degree of compression of the charged metal powder may be determined such that gas tightness is ensured through charge of the metallic powder.

According to the invention described in Aspect 10, the inner circumferential surface of the mating hole portion is formed such that the diameter thereof is not reduced toward the front end of the metallic shell. Through employment of such formation, an enlarged gap (insulation space) can be formed between the inner circumferential surface of the metallic shell and the outer circumferential surface of a portion of the insulation member located frontward of the mating shaft portion, or the portion of the insulation member can have an increased thickness. Therefore, voltage endurance can be enhanced. When the present invention is embodied, gas tightness can be further enhanced through employment of the following configuration: another support ledge is provided on the inner circumferential surface of the metallic shell at a position located frontward of the front end of the filler, and a corresponding butt portion provided on the insulation member butts against the support ledge via a packing for maintaining gas tightness. However, the provision of such support ledge reduces the distance between the inner circumferential surface of the metallic shell and the outer circumferential surface of a front end portion of the insulation member or causes a failure to secure the thickness of the insulation member.

In association with a demand for a reduction of the size (diameter) of the spark plug, there is demand for a reduction of the diameter of the metallic shell, such as a reduction of the thread diameter of the mounting screw formed on the outer circumferential surface of the metallic shell to M12. Under such circumstances, difficulty is encountered in securing the thickness of the insulation member. In such circumstances, when the support ledge is provided in a region located frontward of the filler, the insulation space between the support ledge and the insulation member reduces in size, or the wall thickness of the insulation member reduces. As a result, an abnormal discharge is generated between the support ledge and the insulation member, or voltage endurance is impaired, with a resultant occurrence of damage to the insulation member, such as formation of a hole in the insulation member. By contrast, according to the invention described in Aspect 10, the inner circumferential surface of the mating hole portion is formed such that the diameter thereof is not reduced toward the front end of the metallic shell. As a result, the insulation member can have an increased thickness, whereby voltage endurance can be enhanced. Such an effect is more marked with a small-sized spark plug having a thread diameter of the mounting screw formed on the outer circumferential surface of the metallic shell of M12 (metric threads having a major diameter of 12 mm) or less as in the case of the invention described in Aspect 12.

DETAILED DESCRIPTION OF PREFERRED EMBODIMENTS

Figure 1:
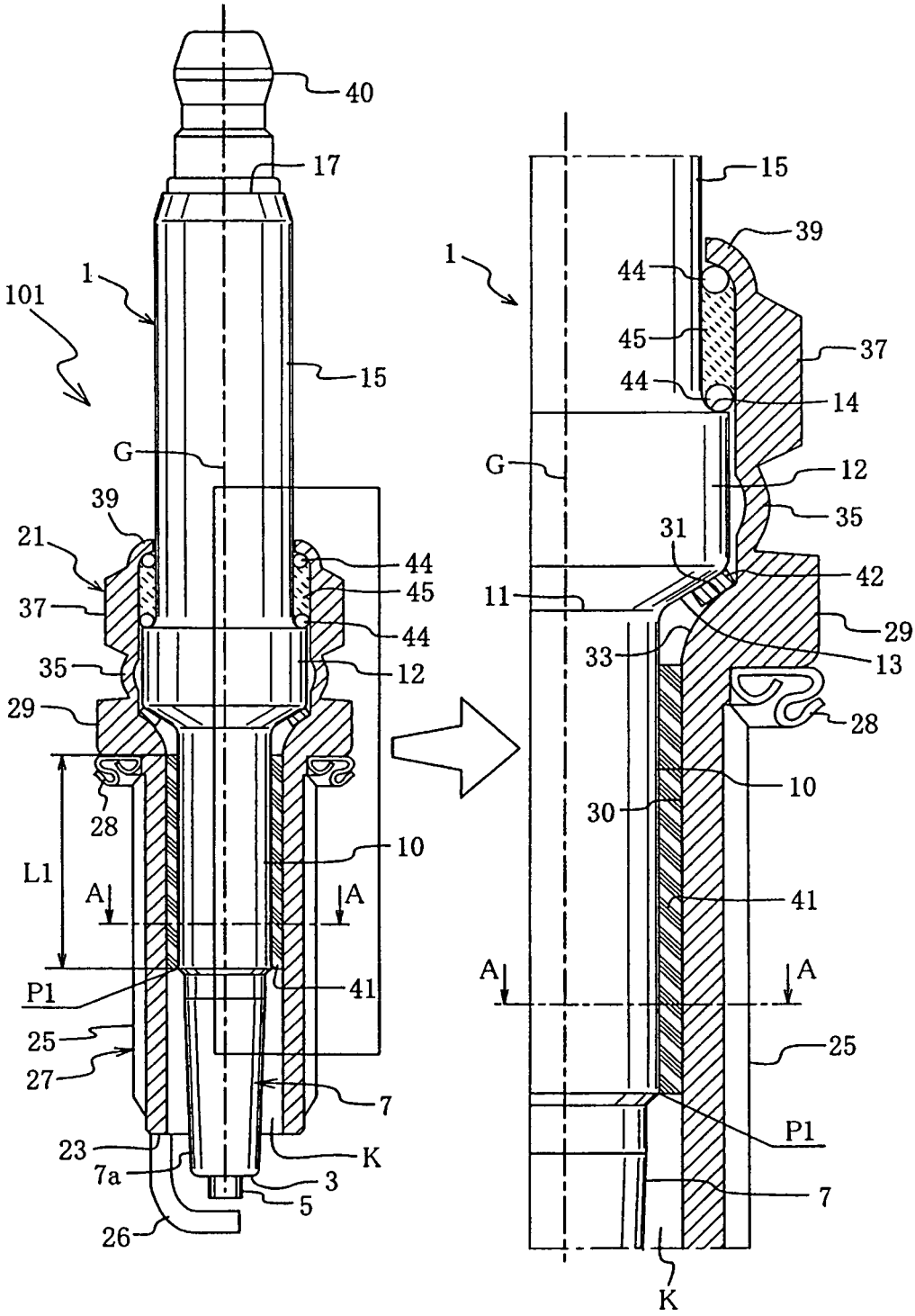
FIG. 1 is a vertical sectional view showing a spark plug according to an embodiment of the present invention and an enlarged view showing essential portions of the spark plug.
Figure 2:
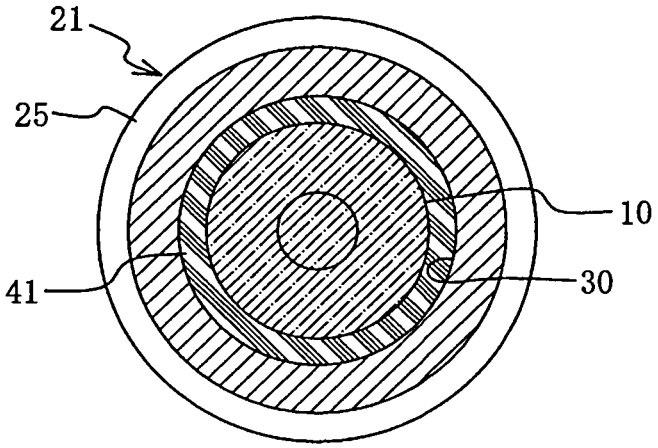
FIG. 2 is a sectional view taken along line A-A of FIG. 1.

A spark plug according to an embodiment of the present invention will be described in detail with reference to FIGS. 1 and 2. FIG. 1 is an explanatory, vertical sectional view of the spark plug and an enlarged view showing essential portions of the spark plug. A spark plug 101 includes a hollow, shaft-like (tubular) insulation member 1 made of ceramic and having a center electrode 5 projecting from a front end 3 thereof, and a tubular metallic shell 21 fixing the insulation member 1 in a surrounding manner and having a ground electrode 26 provided at a front end 23 thereof. In the present embodiment, the metallic shell 21 is made of low-carbon steel (specifically, carbon steel for cold heading having a carbon content of 0.25%).

The metallic shell 21 includes a cylindrical, straight tube portion 27 located toward the front end of the metallic shell 21. A mounting screw (e.g., M12 or M14) 25, is formed on the outer circumferential surface of the straight tube portion 27, and extends in the axial direction along substantially the overall length (in the present embodiment, 18 mm or more) of the straight tube portion 27. Mounting screw 25 is dimensioned to be screwed into a plug hole of an engine. A flange-like seating ring portion 29 having a diameter greater than the outside diameter of the straight tube portion 27 is provided to be seated on an engine head via a gasket (seal washer) 28 when the mounting screw 25 is screwed in. In the present embodiment, the inner circumferential surface of the straight tube portion 27 extends from the front end 23 of the metallic shell 21 toward the rear end of the straight tube portion 27 with uniform diameter, thereby forming a mating hole portion 30. The metallic shell 21 has a support ledge 31 that extends rearward from the rear end of the mating hole portion 30, which is the inner circumferential surface of the straight tube portion 27, and assumes the form of an annular surface facing rearward and having a diameter greater than the hole diameter of the mating hole portion 30. In the present embodiment, the support ledge is located in a region corresponding to the inner circumferential surface of the seating ring portion 29; expands rearward in a tapered manner; and is convexly radiused, as viewed on a vertical section, at a transition portion 33 connected to the mating hole portion 30. The support ledge 31 may assume the form of a flat, ring-like seat surface in place of the tapered ring-like seat surface.

The metallic shell 21 has a tool engagement portion 37 for screwing use located rearward of the seating ring portion 29 with a thin-walled cylindrical portion 35 provided therebetween and a crimp cylinder portion 39 serving as a crimp portion and located at the rear end of the tool engagement portion 37. Before the spark plug is assembled, a cylindrical portion consisting of the thin-walled cylindrical portion 35 and the crimp cylinder portion 39 has an inside diameter greater than the hole diameter of the mating hole portion 30 and substantially identical with the diameter of the outer edge of the support ledge 31 located on the inside of the seating ring portion 29 (see FIGS. 3 and 4). FIG. 1 shows a condition in which the spark plug is assembled; i.e., in FIG. 1, as a result of the crimp cylinder portion 39 being crimped frontward, the crimp cylinder portion 39 and the thin-walled cylindrical portion 35 are deformed. Specifically, in the completed spark plug 101, the crimp cylinder portion 39 is bent toward the axis G of the plug and compressed frontward, whereby the insulation member 1 is fixed internally of the metallic shell 21 while being pressed frontward. The outer peripheral surface (profile) of the tool engagement portion 37 has a hexagonal or any other polygonal shape as viewed from the direction of the axis G.

The insulation member 1 includes a front end shaft portion 7 having a taper portion 7*a* located toward the front end, and a mating shaft portion 10, which is formed rearward of the front end shaft portion 7 and whose outside diameter is greater than that of the front end shaft portion 7. The outside diameter of the mating shaft portion 10 is determined such that the mating shaft portion 10 is loose-fitted into the mating hole portion 30 of the metallic shell 21 with a predetermined clearance formed therebetween. The mating shaft portion (cylindrical portion) 10 is axially uniform in outside diameter, and the outside diameter is designed to be about 0.1 mm to 1 mm smaller than the inside diameter of the mating hole portion 30 (the illustration is exaggerated). A filler 41 for maintaining gas tightness; specifically, a heat-resistant adhesive (e.g., epoxy-resin-based adhesive (curing temperature 200° C.)), is provided in a filling manner between the inner circumferential surface of the mating hole portion 30 and the outer circumferential surface of the mating shaft portion 10 and forms a cylindrical layer (see FIG. 2), thereby bonding the inner and outer surfaces together and thus maintaining gas tightness along the direction of the axis G.

The filler 41 is provided in a filling manner in a region having dimension L1 extending from the front end (mating front end) P1 of the mating shaft portion 10 to near rear end of the mating shaft portion 10; i.e., the filler 41 is provided in a filling manner in a region extending over substantially the whole length of the mating shaft portion 10 along the axis G. Meanwhile, the front end P1 of the mating shaft portion 10 is located at a position corresponding to a substantially middle position of the mating hole portion 30 of the metallic shell 21 with respect to the direction of the axis G. Thus, an annular (cylindrical) space (insulation space) K is formed between the inner circumferential surface of the mating hole portion 30 and the outer circumferential surface of the front end shaft portion 7 located frontward of the front end P1 of the mating shaft portion 10.

In the present embodiment, the rear end of the mating shaft portion 10 is located at a position corresponding to the support ledge 31 with respect to the direction of the axis G. At a rear end 11 of the mating shaft portion 10, there is provided a flange-like large-diameter shaft portion 12 which is greater in diameter than the mating shaft portion 10 and whose outer circumferential surface projects radially outward. The front end of the large-diameter shaft portion 12 and the rear end 11 of the mating shaft portion 10 are connected via a butt portion 13, which assumes the form of an annular facing-frontward surface tapered according to the support ledge 31. A rear shaft portion 15 smaller in diameter than the large-diameter shaft portion 12 is located rearward of the large-diameter shaft portion 12 and projects rearward from the rear end of the metallic shell 21 coaxially with the metallic shell 21. A terminal (electrode terminal) 40 projects from a rear end 17 of the rear shaft portion 15 of the insulation member 1.

In the interior (hollow portion) of the insulation member 1, although unillustrated, the center electrode 5 projecting from the front end of the insulation member 1 is fixed by means of seal glass; a resistor is disposed rearward of the seal glass; and the terminal 40 projecting from the rear end of the insulation member 1 is fixed by means of seal glass. Such an internal configuration of the insulation member 1 is similar to a conventionally known one.

In the present embodiment, the butt portion 13, which assumes the form of a frontward-facing surface, of the large-diameter shaft portion 12 of the insulation member 1 butts against the support ledge 31 of the metallic shell 21 via a ring-like packing (flat packing) for maintaining gas tightness, whereby a frontward movement of the insulation member 1 is checked. That is, in the present embodiment, the support ledge 31 and the butt portion 13 constitute stopper means. Gas tightness between the support ledge 31 and the butt portion 13 is also maintained by means of the packing (packing made of SPCC) 42 for maintaining gas tightness. In this butting condition, the front end 3 of the insulation member 1; i.e., the front end of the front end shaft portion 7, projects from the front end 23 of the metallic shell 21 by an appropriate amount, and the center electrode 5 is held such that a predetermined gap is formed between the ground electrode 26 and the front end of the center electrode 5.

In this butting condition, the rear end of the large-diameter shaft portion 12 of the insulation member 1 (the boundary between the large-diameter shaft portion 12 and the rear shaft portion 15) is located frontward of the crimp cylinder portion 39 located at the rear end of the metallic shell 21. An O-ring 44, a talc 45, and an O-ring 44 are disposed on the inside of the crimp cylinder portion 39 and intervene between the crimp cylinder portion 39 and a facing-rearward surface 14 located on the rear end of the large-diameter shaft portion 12. The crimp cylinder portion 39 is compressively deformed through crimping, whereby the insulation member 1 is fixed while being pressed frontward. The insulation member 1 can also be fixed without use of the O-rings and the talc.

Figure 3:
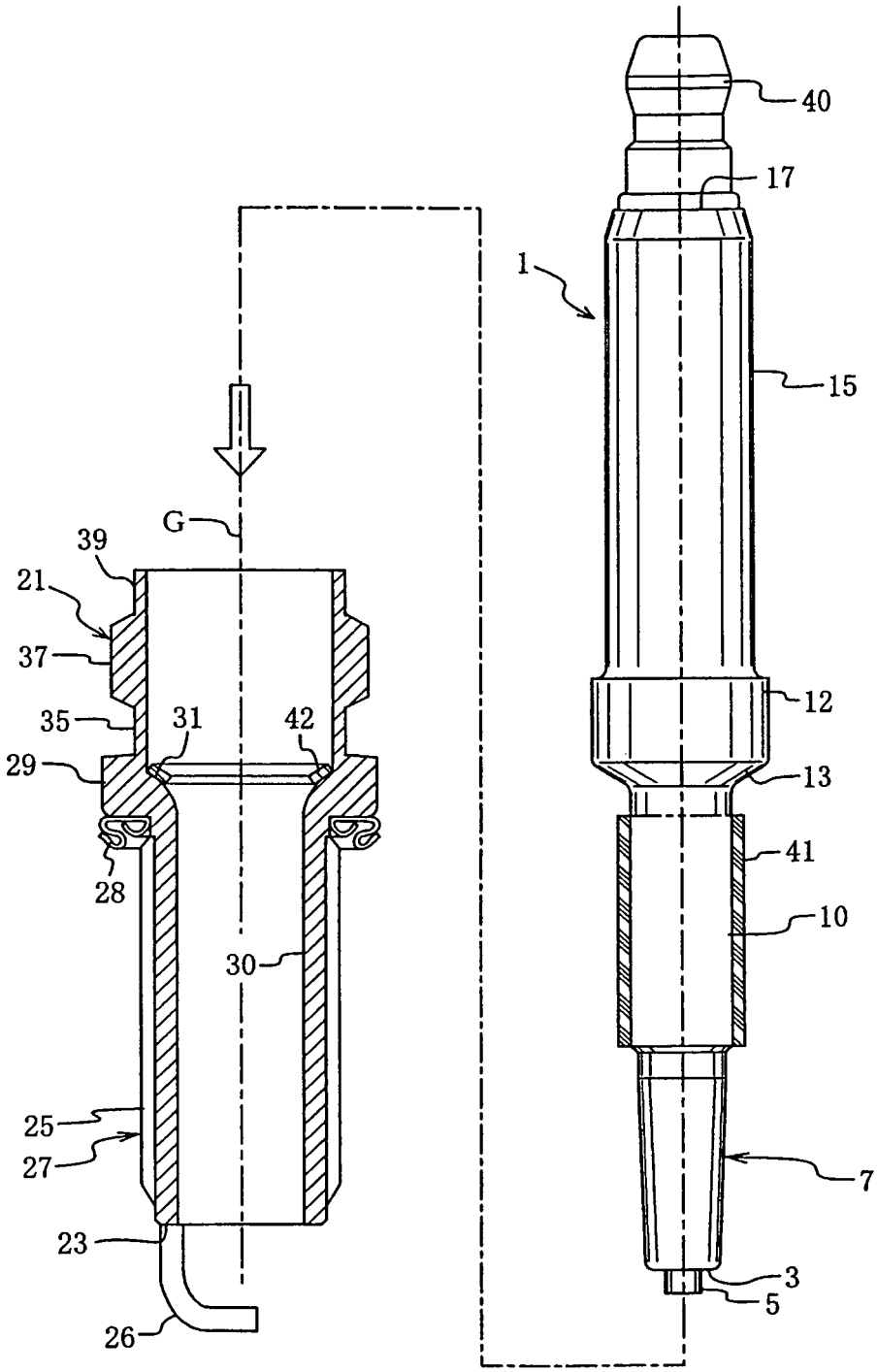
FIG. 3 is a vertical sectional view for explaining an assembling process for the spark plug of FIG. 1.
Figure 4:
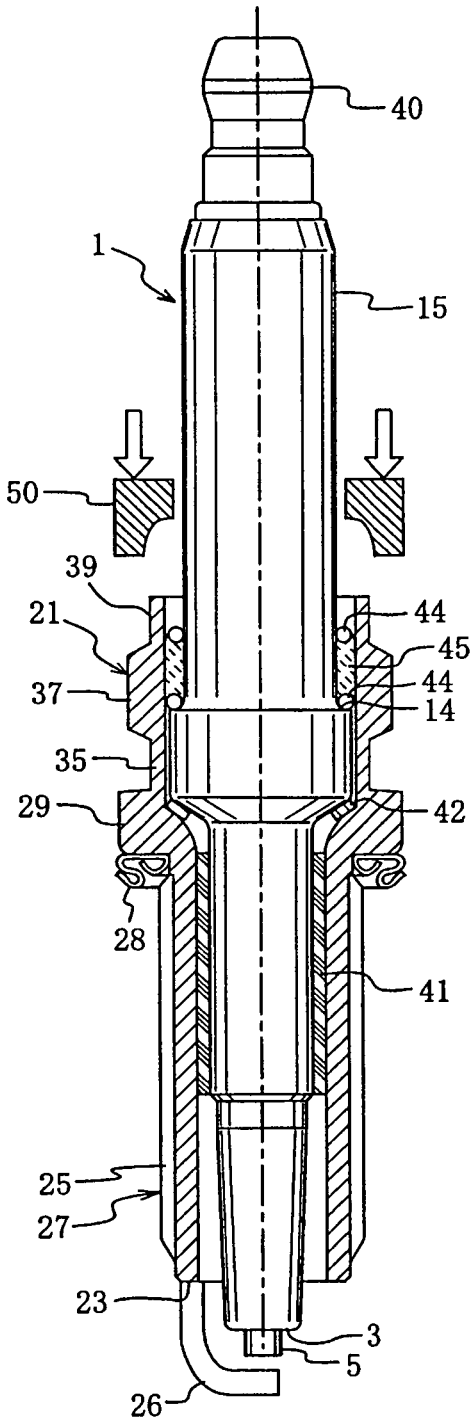
FIG. 4 is a vertical sectional view for explaining an assembling process for the spark plug of FIG. 1.

The spark plug 101 of the present embodiment described above is assembled in the following manner (see FIGS. 3 and 4). A heat-resistant adhesive (in the present embodiment, epoxy-resin-based adhesive) which serves as the filler 41 is applied in an appropriate amount to the outer circumferential surface of the mating shaft portion 10 of the insulation member 1 having the center electrode 5, etc., fixed therein. Meanwhile, the packing 42 is placed on the support ledge 31 that is located on the inside of the metallic shell and that assumes the form of a rearward-facing surface (see FIG. 3). Next, the insulation member 1 having the center electrode 5, etc., fixed therein is inserted into the metallic shell 21 from the rear end of the metallic shell 21. At this time, the mating shaft portion 10 of the insulation member 1 is fitted into the mating hole portion 30 of the metallic shell 21 while centering is performed for the fitting operation, and the butt portion 13, which assumes the form of a frontward-facing surface, of the insulation member 1 is rendered to butt onto the packing 42 placed on the support ledge 31. As shown in FIG. 4, the O-ring 44, the talc 45, and the O-ring 44 are placed in a cylindrical space located internally of the crimp cylinder portion 39 of the metallic shell 21 and rearward of the annular rearward-facing surface 14 of the rear end of the large-diameter shaft portion 12 of the insulation member 1. Next, a die 50 is pressed frontward so as to inwardly bend and compress frontward the crimp cylinder portion 39 located at the rear end of the metallic shell 21, thereby plastically deforming the crimp cylinder portion 39. Subsequently, the heat-resistant adhesive 41 is rendered to set. Thus, the spark plug 101 of the present embodiment is yielded.

The spark plug 101 of the present embodiment shown in FIG. 1 yields the following effects. The spark plug 101 of the present embodiment is threadingly mounted into an unillustrated plug hole (threaded hole) of an engine via the mounting screw 25 of the metallic shell 21 and is then put to use. In this case, since a front end portion of the plug 101 is exposed to high temperature in blast associated with ignition of fuel gas, the metallic shell 21 and the insulation member 1 expand as a result of exposure to such a thermal change. At this time, since the metallic shell 21 tries to thermally expand far more greatly as compared with the insulation member 1 made of ceramic, the insulation member 1 moves (slides) in relation to the fixed metallic shell 21 in a contracting manner along the direction of the axis G. Meanwhile, the heat-resistant adhesive, which serves as the filler 41 for maintaining gas tightness, is provided in a filling manner between the inner circumferential surface of the mating hole portion 30 of the metallic shell 21 and the outer circumferential surface of the mating shaft portion 10 of the insulation member 1. Therefore, even though the two surfaces undergo relative movement along the direction of the axis G due to difference in thermal expansion coefficient, the condition of close contact between the two surfaces is held intact via the heat-resistant adhesive, which serves as the filler 41. Thus, gas tightness between the two surfaces is not impaired.

Also, since the condition of close contact between the two surfaces is held intact via the heat-resistant adhesive, heat of the center electrode 5 and the insulation member 1 can be transferred to an engine head via the filler 41 and the metallic shell 21 without impairment in heat transference. Therefore, the occurrence of preignition and thermal erosion of the electrode can also be effectively prevented.

Additionally, in the present embodiment, the butt portion 13 butts against the support ledge 31 via the annular packing 42 for maintaining gas tightness, and the packing 42 therebetween is axially compressed by press working. Accordingly, gas tightness between the inner circumferential surface of the metallic shell 21 and the outer circumferential surface of the insulation member 1 is secured by means of the packing 42. Therefore, the plug structure has highly reliable gas tightness. Particularly, in the present embodiment, since this gas tightness is established on the support ledge 31 in a region located rearward of the mating hole portion 30 and located greatly away from a front end region of the plug 101, a temperature rise in the region is relatively low. In this sense, too, gas tightness defect stemming from thermal expansion is unlikely to occur. Thus, the spark plug 101 can have highly reliable gas tightness.

Further, in the present embodiment, the filling region L1 for the filler 41 along the axis G of the spark plug 101 is provided rearward starting from the mating front end P1 of the mating shaft portion 10 of the insulation member 1. Thus, a fine space (a fine space associated with loose fit) is not formed between the outer circumferential surface of the mating shaft portion 10 and the inner circumferential surface of the mating hole portion 30, there can be prevented the occurrence of high-temperature gas stagnating or remaining in the fine clearance which would otherwise be formed, thereby preventing the occurrence of excessive rise of temperature.

Also, in the present embodiment, a front end portion of the metallic shell 21 serves as a cylindrical, straight tube portion 27, and the inner circumferential surface of the straight tube portion 27 extends straight from the front end of the metallic shell 21 toward the rear end of the straight tube portion 27 with uniform diameter and has a circular cross section, thereby serving as the mating hole portion 30. That is, the inner circumferential surface of the mating hole portion 30 extends toward the front end 23 of the metallic shell 21 without reduction of diameter. Therefore, the inner circumferential surface of the mating hole portion 30 does not have a portion projecting toward the outer circumferential surface of the front end shaft portion 7 (toward the axis G) located frontward of the mating shaft portion 10 of the insulation member 1. Therefore, the insulation space K between the inner circumferential surface of the metallic shell 21 (mating hole portion 30) and the outer circumferential surface of the front end shaft portion 7 of the insulation member 1 can assume a greater radial dimension up to the root (rear end) of the front end shaft portion 7, as compared with conventional practice. As for the insulation member 1, the front end shaft portion 7 can have a large wall thickness as measured radially, whereby voltage endurance can be enhanced. Thus, the effect of preventing the occurrence of abnormal discharges can be enhanced accordingly. Such an effect is greatly marked with a spark plug which encounters difficulty in assuming such a dimension, such as a spark plug whose mounting screw 25 has a particularly small thread diameter; for example, M12 (metric threads having a nominal diameter of 12 mm).

In the embodiment mentioned above, the region which extends along the axis G and in which the filler is provided in a filling manner extends over substantially the whole length of the mating shaft portion 10 along the axis G. Thus, a close-contact region (close-contact area) between the insulation member 1 and the metallic shell 21 is large; therefore, thermal conductance to an engine head is excellent. However, basically, the region which extends along the axis G and in which the filler 41 is provided in a filling manner may have any length, so long as sufficient gas tightness is maintained. Therefore, the length may be determined as appropriate according to the type, material, etc., of the filler 41.

Figure 5:
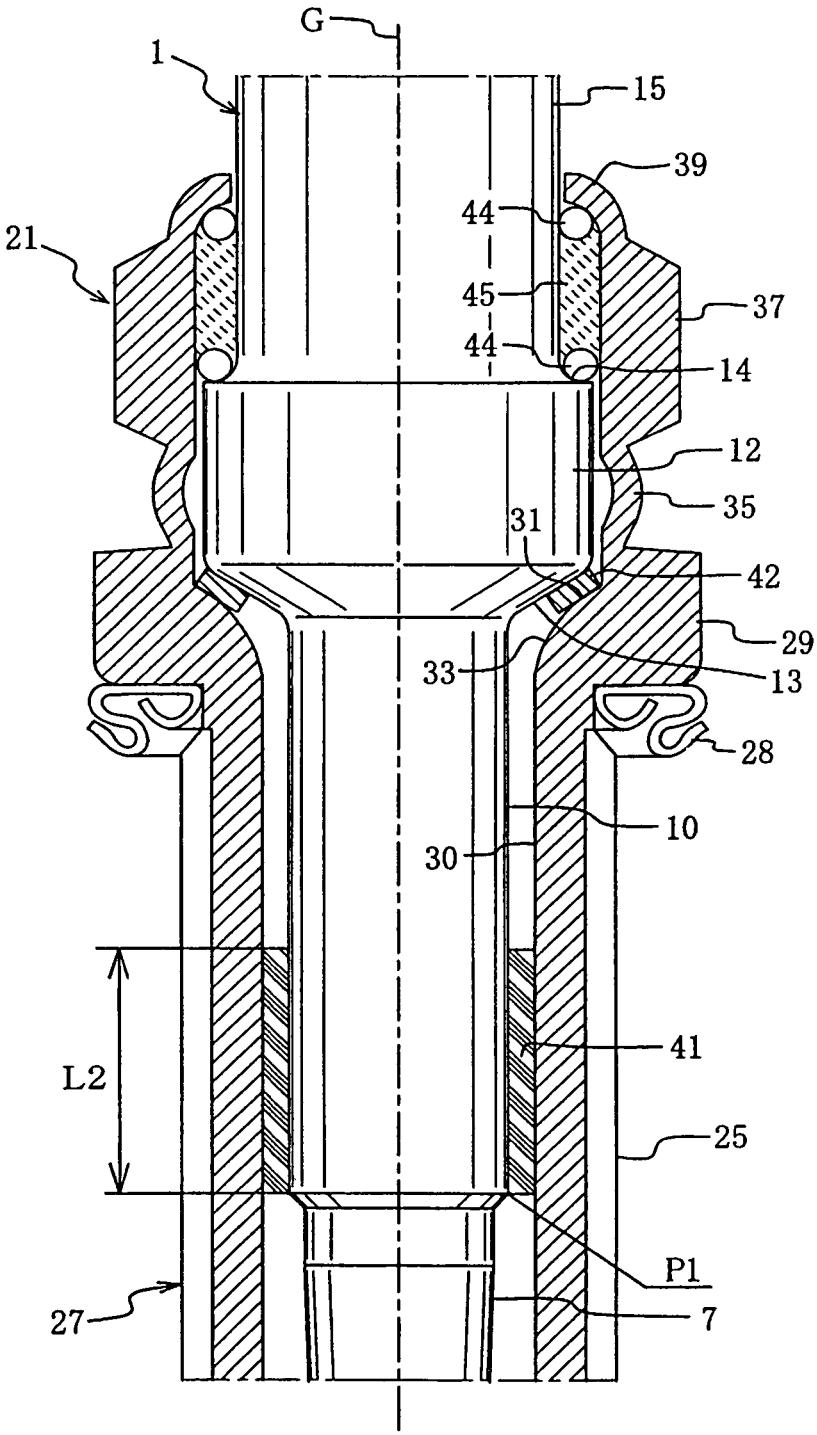
FIG. 5 is an enlarged view showing essential portions of the spark plug for explaining another filling region for a filler.
Figure 6:
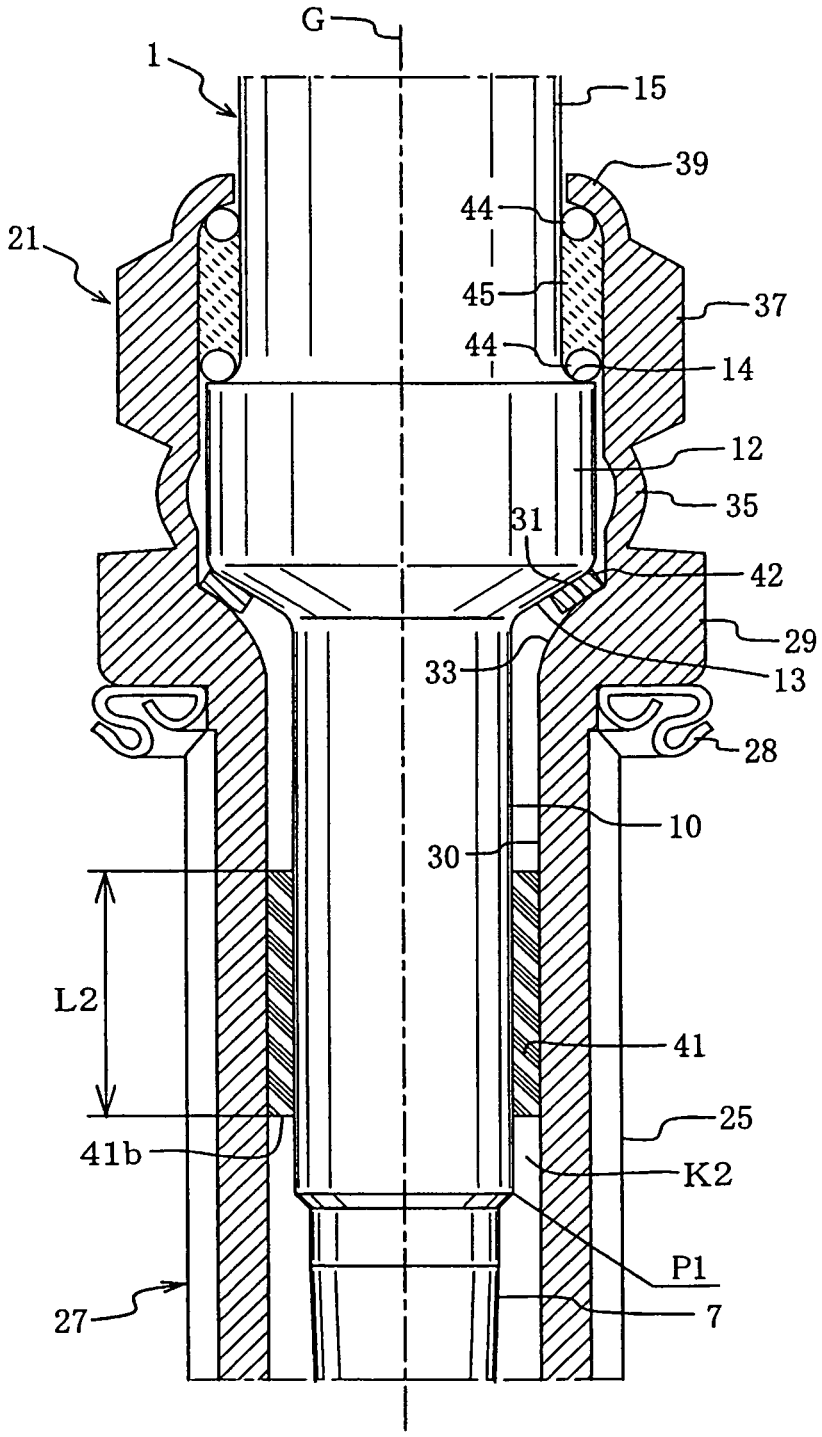
FIG. 6 is an enlarged view showing essential portions of the spark plug for explaining still another filling region for the filler.

Specifically, the region in which the filler 41 is provided may extend along any length, so long as gas tightness is maintained safely and sufficiently. As shown in FIG. 5, the region may be a region having dimension L2 extending from the front end (mating front end) P1 of the mating shaft portion 10 to near the middle position of the mating shaft portion 10. Since the embodiment of FIG. 5 differs from the embodiment described above only in the constitution of the filler 41, in FIG. 5, like parts are denoted by like reference numerals. The same also applies to the following description. In view of gas tightness, as shown in FIG. 6, a region having dimension L2 may be located at an intermediate position of the mating shaft portion 10. However, in this case, a fine space K2 associated with loose fitting appears ahead of a front end 41*b* of the filler 41. High-temperature gas stagnates in the space K2 and promotes an increase in the temperature of a front end portion of the plug. Therefore, even though gas tightness can be maintained by means of the region having dimension L2 smaller than dimension L1, preferably, as shown in FIG. 5, the filler 41 is provided in a filling manner in a predetermined region extending rearward starting from the front end P1 (mating front end) of the mating shaft portion 10.

In the embodiment described above, the heat-resistant adhesive is used as the filler 41. However, as mentioned above, the present invention allows a metal powder having good thermal conductivity (e.g., iron powder) to be contained in the heat-resistant adhesive. In this case, as a result of the metal powder being contained, thermal conductivity between the insulation member 21 and the metallic shell 1 is enhanced accordingly.

In the embodiment described above, since an epoxy-resin-based adhesive having a curing temperature of 350° C. or lower is used as the heat-resistant adhesive which serves as the filler 41, a step of heating the metallic shell 21 to high temperature is not required in the course of assembly of the spark plug in contrast to the case where a brazing filler metal having high melting point is used as the filler. Specifically, in the case where, in place of such a heat-resistant adhesive employed in the embodiment described above, a silver brazing filler metal, for example, is used as the filler, the silver brazing filler metal is applied as follows: heat is applied for heating to, usually, at least 600° C. or so, the temperature depending on the composition of the brazing filler metal, and then the temperature is maintained for a certain time for reflow (fusion), followed by gradual cooling in the atmosphere for curing (setting). Thus, the metallic shell is subjected to heat treatment at a high temperature and consequently suffers a deterioration of mechanical strength. By contrast, in the embodiment described above, since the heat-resistant adhesive which cures at 350° C. or lower is used and can be cured without need to employ such high-temperature heat treatment, a deterioration of mechanical strength can be prevented.

In the case where the embodiment described above uses a brazing filler metal as the filler, as mentioned above, in a condition in which, with the insulation member 1 inserted into the metallic shell 21, the brazing filler metal having an appropriate shape is disposed between the inner circumferential surface of the metallic shell 21 and the outer circumferential surface of the insulation member 1, the brazing filler metal is melted through application of heat. More specifically, when the insulation member 1 having the center electrode 5, etc., fixed therein is inserted into the metallic shell 21 having the mounting screw 25, etc., formed thereon from the rear end of the metallic shell 21, a brazing filler metal having, for example, a ring-like shape is disposed at an appropriate position between the mating shaft portion 10 of the insulation member 1 and the mating hole portion 30 of the metallic shell 21. After the insertion, the crimp cylinder portion 39, that is located at the rear end of the metallic shell 21, is bent inward and compressed frontward to thereby be plastically deformed, thereby fixing the insulation member 1. The resultant spark plug in process is heated to a temperature at which the silver brazing filler metal is heated to its melting point or higher (600° C. or higher), and held at the temperature for a certain time. After the silver brazing filler metal is melted, for example, the spark plug in process is subjected to gradual cooling to set (harden) the filler metal.

Meanwhile, the metallic shell 21 is formed from a material mentioned above through subjection to cold forging, thread rolling, etc. Therefore, when the metallic shell 21 is subjected to brazing mentioned above, the heat treatment causes a deterioration of a mechanical property (strength). The deterioration of strength causes the occurrence of defect such as the following: when the spark plug as a product is screwed into a plug head of an engine head, torsional stress, tensile stress, etc., cause the metallic shell 41 to be fractured in a cutting or shearing manner in the vicinity of the rear end (base region) of the mounting screw 25 formed on the outer circumferential surface of the straight tube portion 27. By contrast, since the embodiment described above uses the heat-resistant adhesive (epoxy-resin-based adhesive) which cures at 350° C. or lower, such high-temperature heat treatment is not required. Thus, there is yielded the effect that the occurrence of such problem is prevented without involvement of deterioration of mechanical strength. In view of difficulty in securing the wall thickness of the metallic shell 21 due to a reduction in size or diameter of the metallic shell 21, the effect is remarkable.

Figure 7:
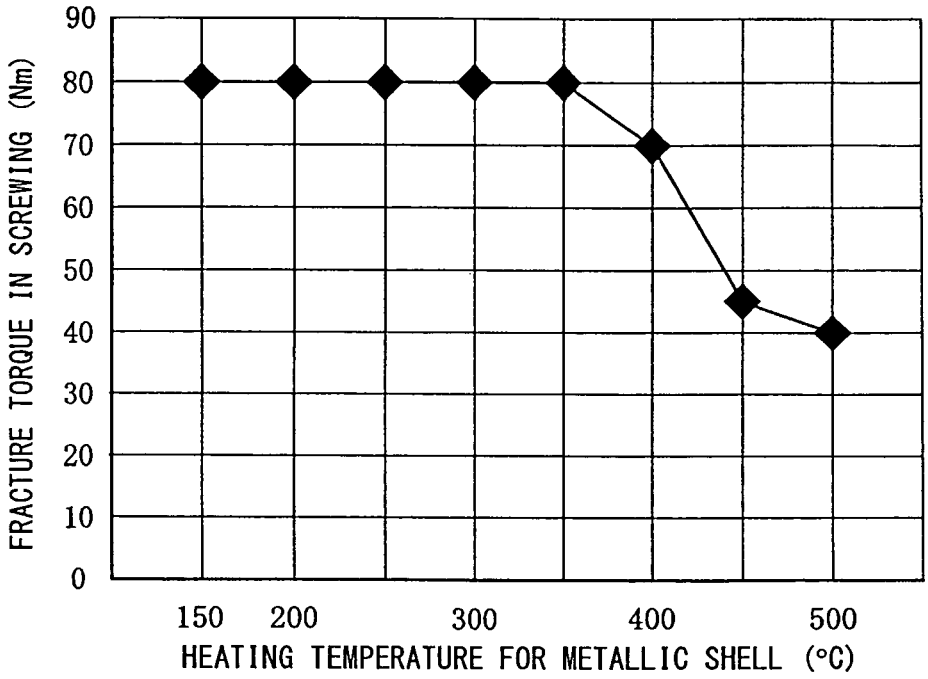
FIG. 7 is a graph showing the relation between the heating temperature for a metallic shell and the fracture torque in screwing.

In order to verify the relation between the heating temperature for the metallic shell and the tightening torque (fracture torque) as measured at the occurrence of the above-mentioned fracture in the course of screwing, samples of the spark plug 101 of the embodiment described above (FIG. 1) were fabricated by use of the metallic shells (mounting screw: M12) which were formed from SWRCH25K and subjected to application of heat in a range of 150° C. to 500° C. (50-degree intervals). The samples were subjected to the real screwing breakdown test. In the test, the screwing torque at the time of fracture of the metallic shell (fracture torque) was measured. FIG. 7 shows the test results. Heating conditions were as follows: heating in an electric furnace, retention of a test temperature for one hour, and gradual cooling in the atmosphere. The number of samples is 10 for each test temperature, and data are average values.

As shown in FIG. 7, at a heating temperature of 350° C. or lower, the associated fracture torque was substantially constant; specifically, 80 Nm. By contrast, at 400° C., the samples were fractured at a torque of 70 Nm. Further, at 450° C., the fracture torque sharply reduced to 45 Nm. Particularly, at 500° C., the samples were fractured at a torque of 40 Nm, and strength dropped to about half that at a heating temperature of 350° C. or lower. The real screwing breakdown test was also conducted on samples whose metallic shells were made of the same material and had a mounting screw of M14. Also, in this case, strength dropped at substantially a similar rate. In this manner, the test has revealed the following: when the metallic shell is heated to 400° C. or higher, a deterioration of strength is clearly observed, whereas, at a heating temperature of 350° C. or lower, strength is not affected. Therefore, no problem arises in the case where the metallic shell is formed from a material which is heat-resistant such that strength does not deteriorate even in exposure to a brazing temperature. However, in the case where the metallic shell is formed from the above-mentioned material or the like, preferably, the filler cures (sets) at 350° C. or lower; specifically, the filler is a heat-resistant adhesive which cures at a temperature of 350° C. or lower without need to be subjected to a thermally melting process. The filler is not limited to the above-mentioned heat-resistant adhesive which cures at 350° C. or lower. The filler may be selected on the basis of whether or not the filler is resistant to a temperature (100° C. to 150° C.) to which a region where the filler is used is exposed in the course of use of the spark plug.

Figure 8:
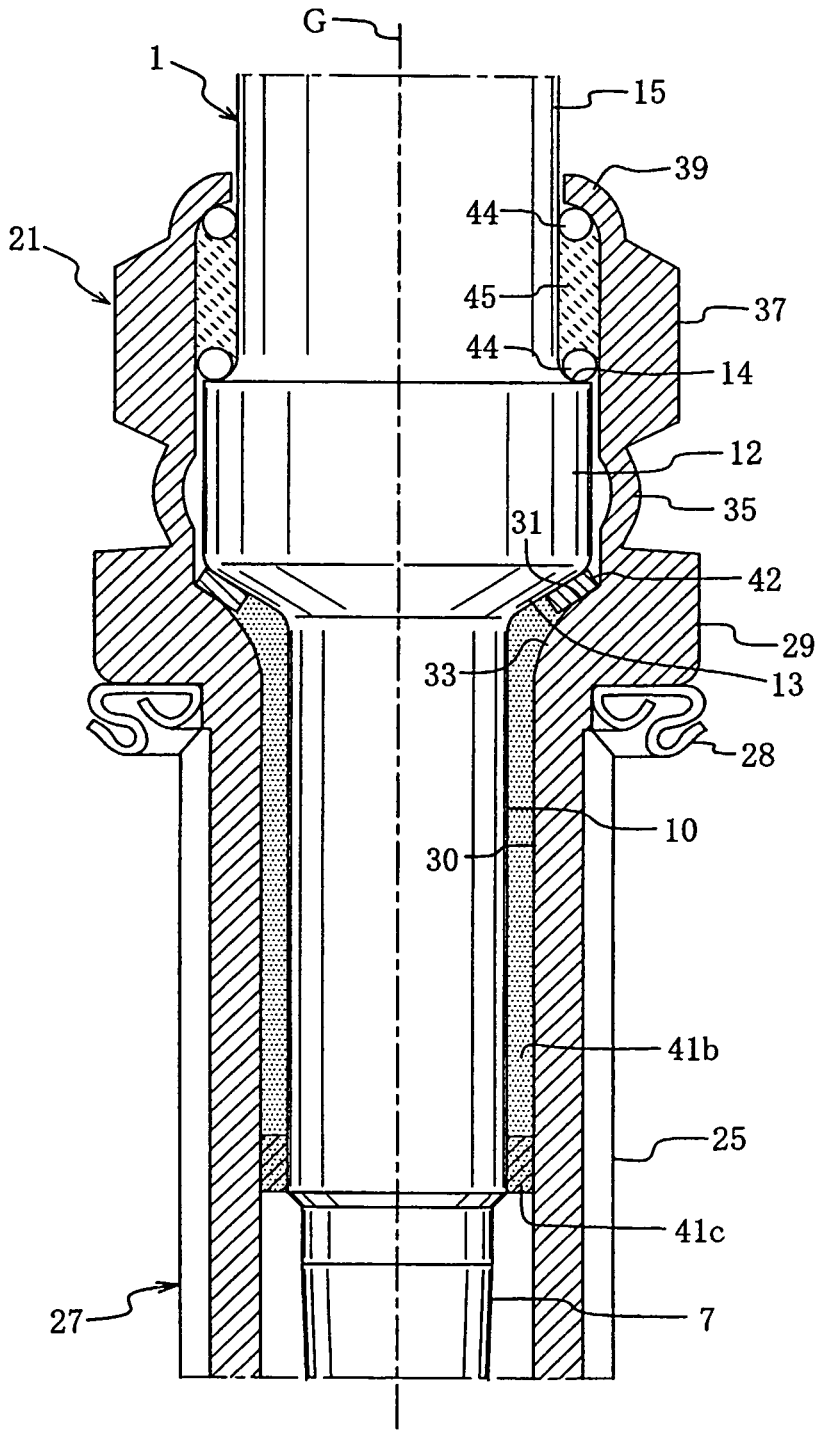
FIG. 8 is an enlarged view showing essential portions of the spark plug for explaining another filler.

Next, another embodiment of the present invention is described with reference to FIG. 8. This embodiment differs from the embodiment of FIG. 1 only in that a metal powder is used solely without use of adhesive as the filler 41; therefore, only the difference is described below. In the present embodiment, in place of the heat-resistant adhesive used in the above-described embodiment, a metal powder (iron powder) 41*b* having a particle size of 5 μm is charged in a predetermined compressed condition into a gap between the inner circumferential surface of the mating hole portion 30 of the metallic shell 21 and the outer circumferential surface of the mating shaft portion 10 of the insulation member 1. However, the present embodiment has the coming-off prevention means for preventing the metal powder 41*b* from coming off toward the front end of the spark plug. The coming-off prevention means is implemented as follows: a front end 41*c* of the metal powder 41*b* charged from the front end of the plug is irradiated with a laser beam along the circumferential direction (along the inner circumferential surface of the metallic shell 21 or the outer circumferential surface of the insulation member 1) so as to fuse or weld the front end of the charged metal powder 41*b* and the inner circumferential surface of the metallic shell 21 together, thereby providing a seal between the inner and outer circumferential surfaces. As is understood from this, a brazing filler metal (brazing filler material), such as silver brazing filler metal, may be melted and solidified for use as the filler 41.

Since the rear end of the filler of the metal powder 41*b* is closed with the support ledge 31 of the metallic shell 21, the packing 42, and the butt portion 13 of the insulation member 1, the metal powder 41*b* may be charged to fill the entire closed space. In assembly of the spark plug of the present embodiment, at the final stage of assembly, the metal powder 41*b* is charged from the front end side of the metallic shell 21 into the gap between the inner circumferential surface of the mating hole portion 30 of the metallic shell 21 and the outer circumferential surface of the mating shaft portion 10 of the insulation member 1 while, for example, ultrasonic vibration is applied. Subsequently, a front end portion of the metal powder is fused and solidified along the inner circumferential surface of the mating hole portion 30.

Figure 9:
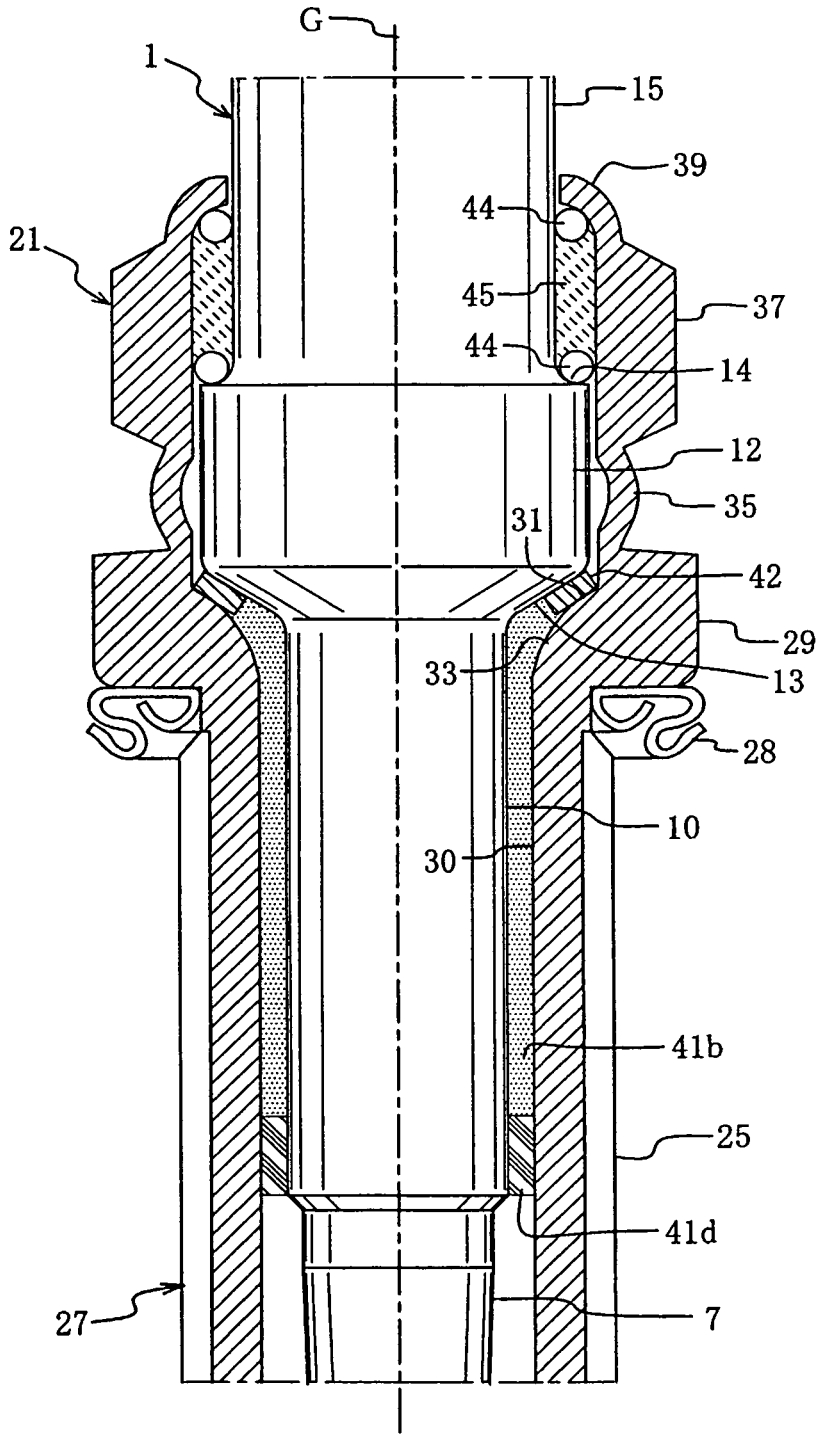
FIG. 9 is an enlarged view showing essential portions of the spark plug for explaining still another filler.
Figure 10:
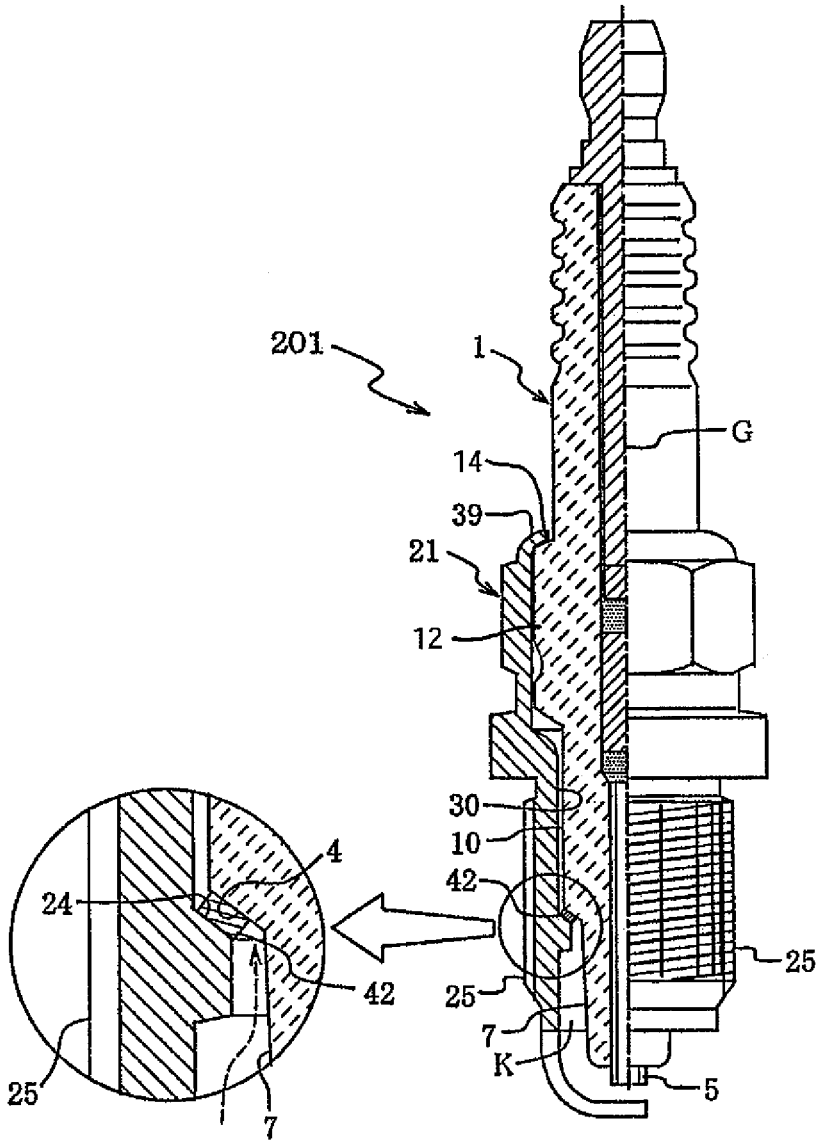
FIG. 10 is a vertical sectional view showing a conventional spark plug and an enlarged view showing essential portions of the spark plug.
Figure 11:
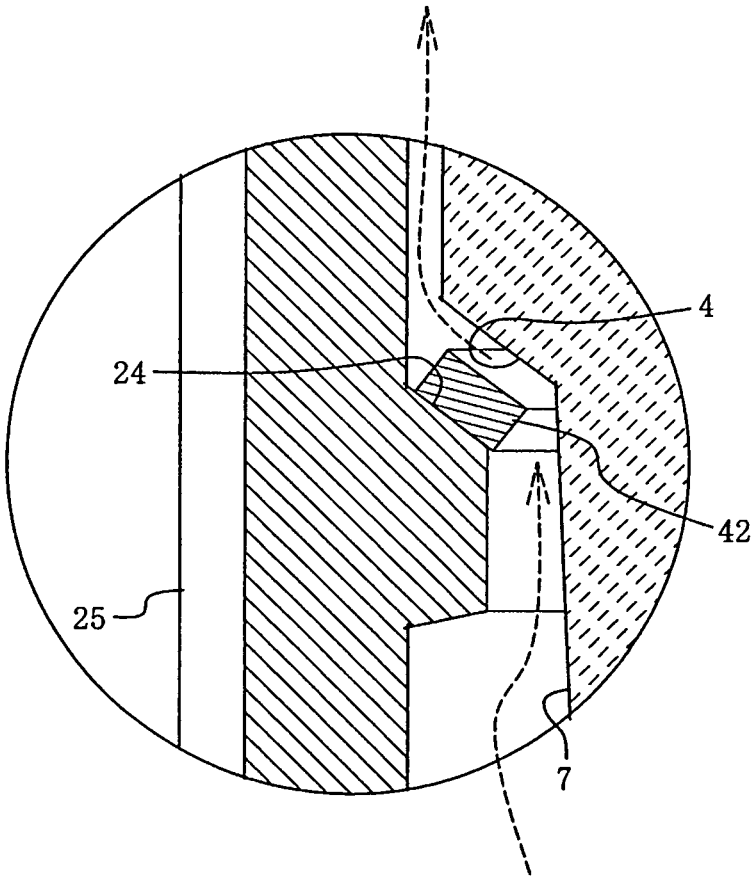
FIG. 11 is a far more enlarged view showing the essential portions of the spark plug of FIG. 10 for explaining problems in the spark plug.

The spark plug according to the present invention is not limited to the embodiments described above, but may be modified as appropriate. For example, as shown in FIG. 9, the coming-off prevention means may be formed in place of use of laser as follows: a brazing filler material 41*d* is charged up to the front end of the filler of the metal powder 41*b* and then fused and solidified. Further, in place of use of laser, an adhesive or resin may be charged and solidified. That is, two or more different fillers may be provided in a filling manner along the direction of the axis G. In this case, preferably, a front end filler has high heat resistance.

Having described the invention, the following is claimed:

1. A spark plug comprising a shaft-like insulation member made of ceramic and having a center electrode projecting from a front end thereof, and a metallic shell fixing the insulation member in a surrounding manner and having a ground electrode provided at a front end thereof, the insulation member having a front end shaft portion located toward a front end thereof and a mating shaft portion located rearward of the front end shaft portion, said mating shaft portion having a diameter greater than that of the front end shaft portion, the metallic shell having an inner circumferential surface of uniform diameter that defines a mating hole portion that extends from the front end of the metallic shell toward the back end of the metallic shell, said mating hole portion dimensioned to receive said front end shaft portion and said mating shaft portion and to form an annular insulation space between said front end shaft portion and said mating shaft portion of the insulation member and the inner circumferential surface of said metallic shell, the insulation member being inserted into the metallic shell from a rear end of the metallic shell, a frontward movement of the insulation member in the course of insertion being checked at a predetermined position by stopper means, and the insulation member being fixed in the metallic shell in a pressed-frontward condition by means of a crimp portion provided at the rear end of the metallic shell being bent toward an axis and pressed frontward, characterized in that the stopper means comprises an annular butt portion of the insulation member located rearward of the mating shaft portion, having a diameter greater than that of the mating shaft portion, and assuming the form of a surface facing frontward, and an annular support ledge of the metallic shell located rearward of the mating hole portion, having a diameter greater than that of the mating hole portion, and assuming the form of a surface facing rearward and the butt portion butts directly or indirectly against the support ledge to thereby check frontward movement of the insulation member, and that a filler for maintaining gas tightness is provided in a filling manner between an outer circumferential surface of the mating shaft portion and an inner circumferential surface of the mating hole portion.

2. A spark plug according to claim 1, wherein the butt portion butts against the support ledge via an annular packing for maintaining gas tightness.

3. A spark plug according to claim 1, wherein the filler is a heat-resistant adhesive.

4. A spark plug according to claim 3, wherein the heat-resistant adhesive contains a metal powder.

5. A spark plug according to claim 3, wherein the filler is provided in a filling manner in a filling region extending 5 mm or more along a direction of the axis of the spark plug.

6. A spark plug according to claim 3, wherein the filler is provided in a filling manner in a filling region extending 5 mm or more along a direction of the axis of the spark plug as measured rearward from a mating front end of the mating shaft portion of the insulation member.

7. A spark plug according to claim 1, wherein the filler is a heat-resistant adhesive which cures at 350° C. or lower.

8. A spark plug according to claim 1, wherein the filler is a compressed metal powder, and coming-off prevention means for preventing the metal powder from coming off toward a front end of the spark plug is provided on an inner circumferential surface of the metallic shell or an outer circumferential surface of the insulation member.

9. A spark plug according to claim 1, wherein the mating hole portion has an inner circumferential surface formed such that a diameter of the inner circumferential surface is not reduced toward a front end of the metallic shell.

10. A spark plug according to claim 1, wherein the metallic shell has a mounting screw formed on an outer circumferential surface thereof for allowing the spark plug to be threadingly mounted into a plug hole of an engine head, and the mounting screw has a thread diameter of M12 or less.

* * * * *